US006633084B1

(12) United States Patent
Sandhu et al.

(10) Patent No.: US 6,633,084 B1
(45) Date of Patent: Oct. 14, 2003

(54) SEMICONDUCTOR WAFER FOR IMPROVED CHEMICAL-MECHANICAL POLISHING OVER LARGE AREA FEATURES

(75) Inventors: Gurtej Singh Sandhu, Boise, ID (US); Chris Chang Yu, Aurora, IL (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/439,734

(22) Filed: Nov. 12, 1999

Related U.S. Application Data

(60) Continuation of application No. 08/914,996, filed on Aug. 20, 1997, now abandoned, which is a division of application No. 08/659,758, filed on Jun. 6, 1996, now Pat. No. 5,681,423.

(51) Int. Cl.[7] ..... H01L 23/48

(52) U.S. Cl. ..... 257/774; 438/692; 438/697; 438/633

(58) Field of Search ..... 257/758, 774, 257/773, 734; 438/692–693, 697–703, 633, 975

(56) References Cited

U.S. PATENT DOCUMENTS

| | | | | |
|---|---|---|---|---|
| 4,268,946 A | | 5/1981 | Eisenberg | |
| 4,404,235 A | | 9/1983 | Tarng et al. | |
| 4,663,890 A | | 5/1987 | Brandt | |
| 4,804,560 A | | 2/1989 | Shioya et al. | |
| 4,940,507 A | | 7/1990 | Harbarger | |
| 5,077,941 A | | 1/1992 | Whitney | |
| 5,094,973 A | | 3/1992 | Pang | |
| 5,191,738 A | | 3/1993 | Nakazato et al. | |
| 5,300,155 A | | 4/1994 | Sandhu et al. | |
| 5,302,233 A | | 4/1994 | Kim et al. | |
| 5,399,233 A | | 3/1995 | Murazumi et al. | |
| 5,422,316 A | | 6/1995 | Desai et al. | |
| 5,539,240 A | | 7/1996 | Cronin et al. | |
| 5,602,423 A | * | 2/1997 | Jain | 257/752 |
| 5,637,539 A | * | 6/1997 | Hofmann et al. | 438/20 |
| 5,639,697 A | * | 6/1997 | Weling et al. | 438/633 |
| 5,834,332 A | * | 11/1998 | Hierold et al. | 438/48 |
| 5,902,752 A | * | 5/1999 | Sun et al. | 438/692 |
| 6,049,134 A | * | 4/2000 | Michael et al. | 257/774 |

FOREIGN PATENT DOCUMENTS

JP 10-6213 * 1/1998 ..... H01L/21/304

OTHER PUBLICATIONS

Blumenstock, K; Theisen, J; Pan, P.; Dulak, J.; Ticknor, A. and Sandwick, T., "Shallow trench isolation for ultra–large–scale integrated devices." *J. Vac. Sci. Techno B* 12(1): 54–58, Jan./Feb. 1994.

* cited by examiner

*Primary Examiner*—Ori Nadav
(74) *Attorney, Agent, or Firm*—Perkins Coie LLP

(57) ABSTRACT

The present invention is a semiconductor wafer, and a method of fabricating the semiconductor wafer, that reduces dishing over large area features in chemical-mechanical polishing processes. The semiconductor wafer has a substrate with an upper surface, a large area feature formed on the substrate, and a separation layer deposited on the substrate. The separation layer has a top surface and a cavity extending from the top surface towards the upper surface of the substrate. The large area feature is positioned in the cavity of the separation layer, and a support pillar is positioned in the cavity. In one embodiment, the pillar has a base positioned between components of the large area feature and a crown positioned proximate to a plane defined by the top surface of the separation layer. In operation, the pillar substantially prevents the polishing pad of a polishing machine from penetrating into the cavity beyond the top surface of the separation layer.

21 Claims, 4 Drawing Sheets

SEMICONDUCTOR WAFER FOR IMPROVED CHEMICAL-MECHANICAL POLISHING OVER LARGE AREA FEATURES

CROSS REFERENCE TO RELATED APPLICATIONS

This application is a continuation of U.S. application Ser. No. 08/914,996 filed Aug. 20, 1997 now abandon which is a divisional of U.S. Pat. No. 5,681,423 which issued on Oct. 28, 1997 (U.S. application Ser. No. 08/659,758, filed on Jun. 6, 1996).

TECHNICAL FIELD

The present invention relates to chemical-mechanical polishing of semiconductor wafers that have large area features; more particularly, the present invention relates to a semiconductor wafer that reduces dishing caused by chemical-mechanical polishing over large area features.

BACKGROUND OF THE INVENTION

Chemical-mechanical polishing ("CMP") processes remove materials from the surface layer of a wafer in the production of ultra-high density integrated circuits. In a typical CMP process, a wafer presses against a polishing pad in the presence of a slurry under controlled chemical, pressure, velocity, and temperature conditions. The solution has abrasive particles that abrade the surface of the wafer, and chemicals that oxidize and/or etch the surface of the wafer. Thus, when relative motion is imparted between the wafer and the pad, material is removed from the surface of the wafer by the abrasive particles (mechanical removal) and by the chemicals (chemical removal) in the slurry.

FIG. 1 schematically illustrates a conventional CMP machine 10 with a platen 20, a wafer carrier 30, a polishing pad 40, and a slurry 44 on the polishing pad. The platen 20 has a surface 22 to which an under-pad 25 is attached, and the polishing pad 40 is positioned on the under-pad 25. The under-pad 25 protects the platen 20 from caustic chemicals in the slurry 44 and from abrasive particles in both the polishing pad 40 and the slurry 44. In conventional CMP machines, a drive assembly 26 rotates the platen 20 as indicated by arrow A. In another, type of existing CMP machine, the drive assembly 26 reciprocates the platen back and forth as indicated by arrow B. The motion of the platen 20 is imparted to the pad 40 because the polishing pad 40 frictionally engages the under-pad 25. The wafer carrier 30 has a lower surface 32 to which a wafer 12 may be attached, or the wafer 12 may be attached to a resilient pad 34 positioned between the wafer 12 and the lower surface 32. The wafer carrier 30 may be a weighted, free-floating wafer carrier, or an actuator assembly 36 may be attached to the wafer carrier 30 to impart axial and rotational motion, as indicated by arrows C and D, respectively.

In the operation of the conventional polisher 10, the wafer 12 is positioned face-downward against the polishing pad 40, and then the platen 20 and the wafer carrier 30 move relative to one another. As the face of the wafer 12 moves across the polishing surface 42 of the polishing pad 40, the polishing pad 40 and the slurry 44 remove material from the wafer 12.

CMP processes must consistently and accurately produce a uniform, planar surface on the wafer because it is important to accurately focus circuit patterns on the wafer. As the density of integrated circuits increases, current lithographic techniques must accurately focus the critical dimensions of photo-patters to within a tolerance of approximately 0.35–0.5 $\mu$m. Focusing the photo-patterns to such small tolerances, however, is very difficult when the distance between the, emission source and the surface of the wafer varies because the surface of the wafer is not uniformly planar. In fact, when the surface of the wafer is not uniformly planar, several devices on the wafer may be defective. Thus, CMP processes must create a highly uniform, planar surface.

FIG. 2 illustrates a specific application of the CMP process in which a wafer 50 is polished on polishing pad 40. The wafer 50 has a substrate 60, a number of device features 62 formed on the substrate 60, a large area feature 80 positioned on the substrate 60, and a dielectric layer 70 deposited over the substrate 60. A large cavity 72 in the dielectric layer 70 is formed around the large area feature 80, and a number of vias 74 are positioned over the device features 62. A first layer of conductive material 90 is deposited over the dielectric layer 70 and the large area feature 80 to fill the vias 74. The first layer of conductive material 90 is subsequently polished with a CMP process to electrically isolate the conductive material in the vias 74 from each other so as to create interconnects 92 between the device features 62 and the top surface 71 of the dielectric layer 70. After the first conductive layer 90 is polished, a second conductive layer (not shown) is deposited over the wafer and patterned (not shown) on the top surface 71 of the dielectric layer 70 to form conductive lines. The first conductive layer 90 is typically tungsten (W), and the second conductive layer is typically aluminum (Al). The aluminum layer, and generally the tungsten layer as well, are opaque layers of material. The large area feature 80 is typically an alignment array with a number of lines 82 that a stepper machine (not shown) scans to align photo-patterns and other fabrication processes on the surface of the wafer 50, such as when the aluminum layer is patterned to form conductive lines. Thus, because aluminum is opaque and the topography of the array of lines 82 must be visible to the stepper machine, it is necessary to etch the cavity 72 in the dielectric layer 70 so that the stepper machine can scan the contour of the tungsten on the lines 82.

One problem with polishing the wafer 50 with a CMP process is that the resulting surface is not uniformly planar because the polishing pad 40 penetrates into the large opening 72 beyond the top surface 71 of the dielectric layer 70. During the polishing process, the polishing surface 42 of the polishing pad 40 conforms to the surface of the conductive layer 90 and often penetrates into the cavity 72 over the large area feature 80. The penetration of the polishing surface 42 shown in FIG. 2 is exaggerated to emphasize the effect over large area features. The polishing pad 40 thus causes the surface of the wafer to "dish" at the surfaces 94 adjacent to the cavity 72. In extreme cases, the polishing pad may even contact the conductive layer 90 over the array of lines 82. As a result, the finished surface of the wafer 50 is not uniformly planar and the topography of the tungsten on top of the lines 82 may be substantially altered. The topography of the resulting aluminum layer on top of the tungsten over the lines 82 may also be altered such that a stepper cannot properly align the pattern on the aluminum layer.

In light of the problems with CMP processing of conventional wafers with large area features, it would be desirable to develop a device and method that reduces dishing caused by chemical-mechanical polishing over large area features.

SUMMARY OF THE INVENTION

The inventive semiconductor wafer reduces dishing over large area features in chemical-mechanical polishing processes. The semiconductor wafer has a substrate with an upper surface, a large area feature formed on the substrate, and a separation layer deposited on the substrate. The separation layer has a top surface and a cavity extending from the top surface towards the upper surface of the substrate. The large area feature is positioned in the cavity of the separation layer, and a support structure is positioned in the cavity. In one embodiment, the support structure is a pillar with a base positioned between components of the large area feature and a crown positioned proximate to a plane defined by the top surface of the separation layer. In operation, the support structure substantially prevents the polishing pad of a polishing machine from penetrating into the cavity beyond the top surface of the separation layer.

In an inventive method for fabricating a semiconductor wafer, a large area feature is formed on an upper surface of a substrate. A separation layer is deposited over the substrate and the large area feature, and then a cavity is etched in the separation layer above the large area feature. A pillar is formed in the cavity, and an upper layer of material is subsequently deposited over the wafer. The wafer is mounted to a wafer carrier of a chemical-mechanical polishing machine and pressed against a polishing pad in the presence of a slurry. As the polishing pad removes the upper layer of material the pillar supports the polishing pad over the cavity in the separation layer to substantially prevent the polishing pad from penetrating into the cavity beyond the top surface of the separation layer.

DETAILED DESCRIPTION OF THE INVENTION

The present invention is a semiconductor wafer that reduces dishing over a large area feature caused by polishing an upper layer of material from the wafer. An important aspect of the present invention is that a support pillar is formed in a cavity in which the large area feature is positioned. The pillar supports the polishing pad as it passes over the large area feature, and thus it reduces the extent to which the pad penetrates into the cavity beyond the desired top surface of the wafer. The pillar, therefore, enhances the uniformity of the surface of, the polished wafer. FIGS. 3–8, in which like reference numbers refer to like parts throughout the various figures, illustrate a semiconductor wafer and a method for making a semiconductor wafer in accordance with the invention.

Figure 3:
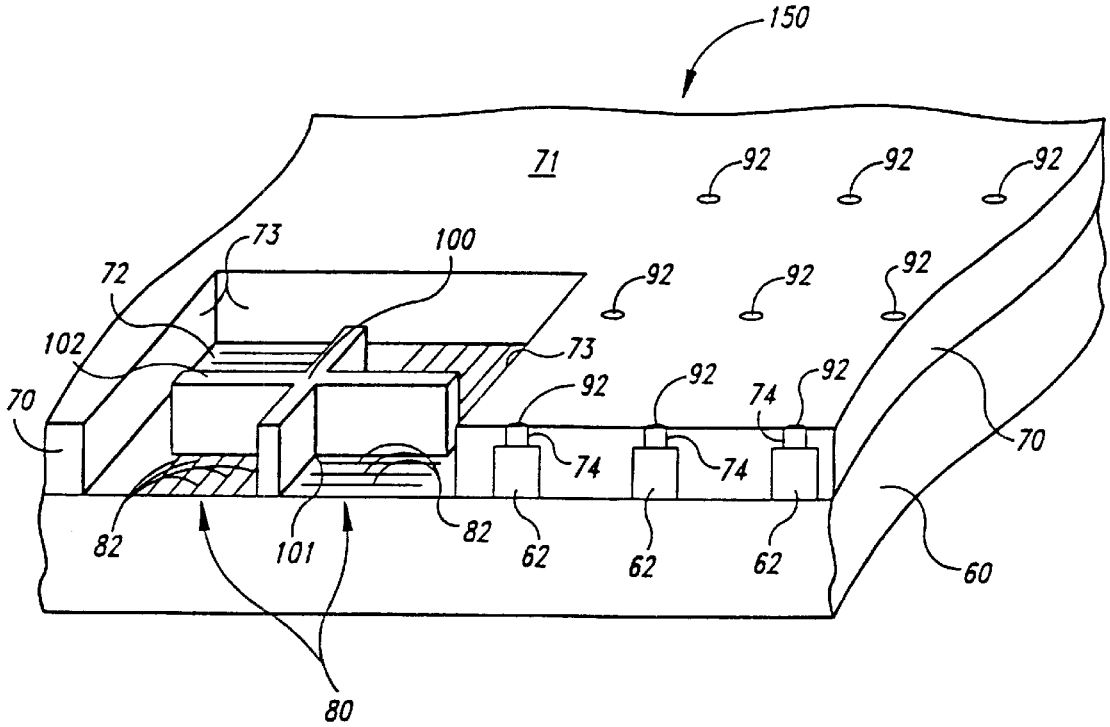
FIG. 3 is a partial isometric view of a wafer in accordance with the invention

FIG. 3 illustrates a portion of a semiconductor wafer 150 that has a substrate 60 made from silicon or any other suitable semiconductive material. A number of device features 62 and a large area feature 80 are formed on the substrate 60. The device features 62 are typically memory cells, transistors, conductive lines, or any type of feature commonly fabricated in semiconductor devices. The large area feature 80 is typically an alignment array with a number of raised component lines 82 for properly aligning a stepping machine (not shown) with the wafer 150. The invention, however, is not limited to any specific device features 62 or large area features 80. A separation layer 70 is deposited over the substrate 60, the device features 62, and the large area feature 80. The separation layer 70 is generally made from borophosphate silicon glass ("BPSG") but it may also be made from silicon dioxide ($SiO_2$) or any other suitable dielectric material. A number of vias 74 are etched into the separation layer 70 from the top surface 71 of the separation layer 70 to the top of the device features 62. The vias 74 are filled with a conductive material such as tungsten or aluminum, to form interconnects 92 between the device features 62 on the substrate 60 and other features (not shown) that will be subsequently fabricated on the top surface 71. A large cavity 72 with walls 73 is etched into the separation layer 70, to expose the component lines 82 of the large area feature 80 to a scanner of a stepper machine (not shown).

A support structure, which is preferably a pillar 100, is formed in the cavity 72 between the walls 78. In a preferred embodiment, the support pillar 100 is positioned it a medial location in the cavity 72. The support pillar 100 has a base 101 situated between the component lines 82 of the large area feature 80 and a crown 102 positioned proximate to a plane defined by the top surface 71 of the separation layer 70. In a preferred embodiment, the pillar 100 is etched from the separation layer 70 when the cavity 72 is formed, but it may also be formed separately from another type of material.

Figure 4:
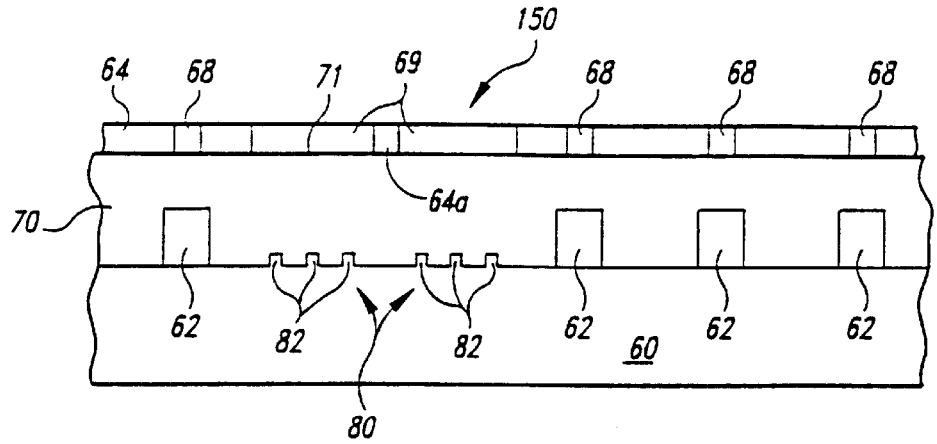
FIG. 4 is a partial schematic cross-sectional view of one step of a method for fabricating a wafer in accordance with the invention.

FIG. 4 illustrates an initial stage of a process for making the wafer 150 in accordance with the invention after the device features 62 and the large area feature 80 are formed on the substrate 60. The separation layer 70 is deposited over the substrate 60, the device features 62, and the large area feature 80 until the top surface 71 of the separation layer 70 is above the top of the device features 62. A photo-resist layer 64 is then patterned on the top surface 71 of the separation layer 70 so that a number of holes 68 are formed above the device features 62 and a large hole 69 is formed above the large area feature 80. Importantly, a portion 64(*a*) of the photo resist 64 is deposited over open spaces in the large area feature 80 to prevent etching of the separation layer 70 over internal areas of the large area feature 80.

Figure 5:
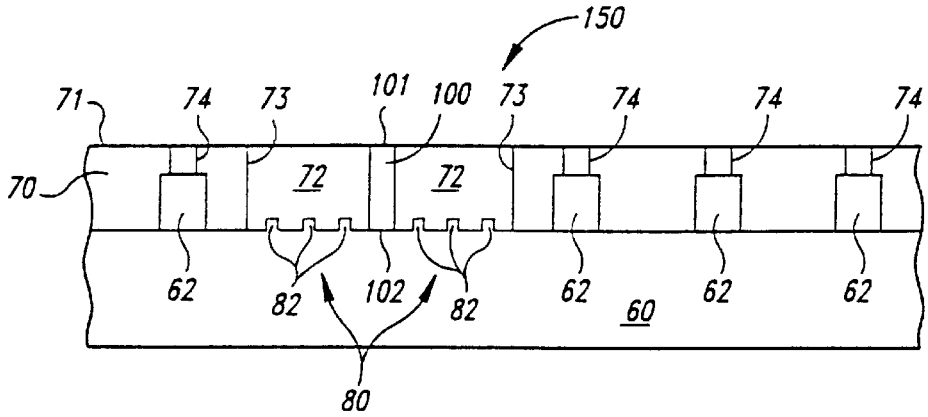
FIG. 5 is a partial schematic cross-sectional view of another step of a method for fabricating a wafer in accordance with the invention.

FIG. 5 illustrates a subsequent stage in the process for fabricating the wafer 150 in which the separation layer 70 is etched to form the cavity 72 and the vias 74. When the cavity 72 is etched from the separation layer 70, the support pillar 100 is formed from the material of the separation layer 70 under the portion 64(*a*) (shown in FIG. 4) of the resist material. The cavity 72 extends from the top surface 71 of the separation layer 70 to a level at which the component lines 82 of the large area feature 80 are exposed. An opaque conductive layer (not shown) can then be deposited on the wafer 150 and into the vias 74 without blocking the sightline to the topography of the component lines 82, as discussed below.

Figure 6:
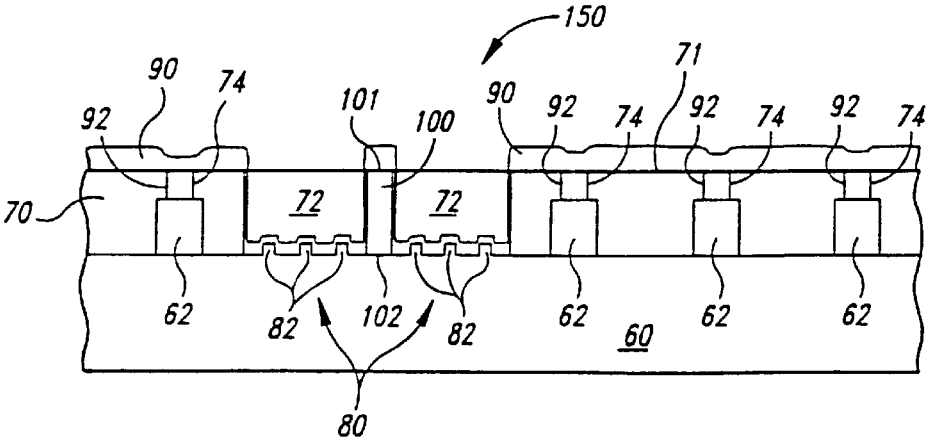
FIG. 6 is a partial schematic cross-sectional view of another step of a method for fabricating a wafer in accordance with the invention.

FIG. 6 illustrates still another stage in the process for fabricating the wafer 150 in which an upper layer 90 is deposited over the wafer 150. In one embodiment, the upper layer 90 is a suitable conductive material, such as tungsten, aluminum or polysilicon. The cavity 72 is formed over the large area feature 80 because the separation layer 70 or the upper layer 90 are generally made from opaque or translucent materials that prevent the stepper (not shown) from scanning they layer area feature. When the upper layer 90 is a conductive material, it fills the vias 74 to form interconnects 92. The upper layer 90 closely follows the contour of the component lines 82 of the large area feature 80 so that a stepper can scan the topography of the component lines 82 defined by the contour of the upper layer 90 to align a pattern on the top surface 71 of the separation layer 70. After the upper layer 90 is deposited, the wafer 150 is polished with a chemical-mechanical polishing process to remove excess portions of the upper layer 90. In the case of a conductive upper layer 90, the wafer 150 is polished to electrically isolate the interconnects 92 from each other.

Figure 1:
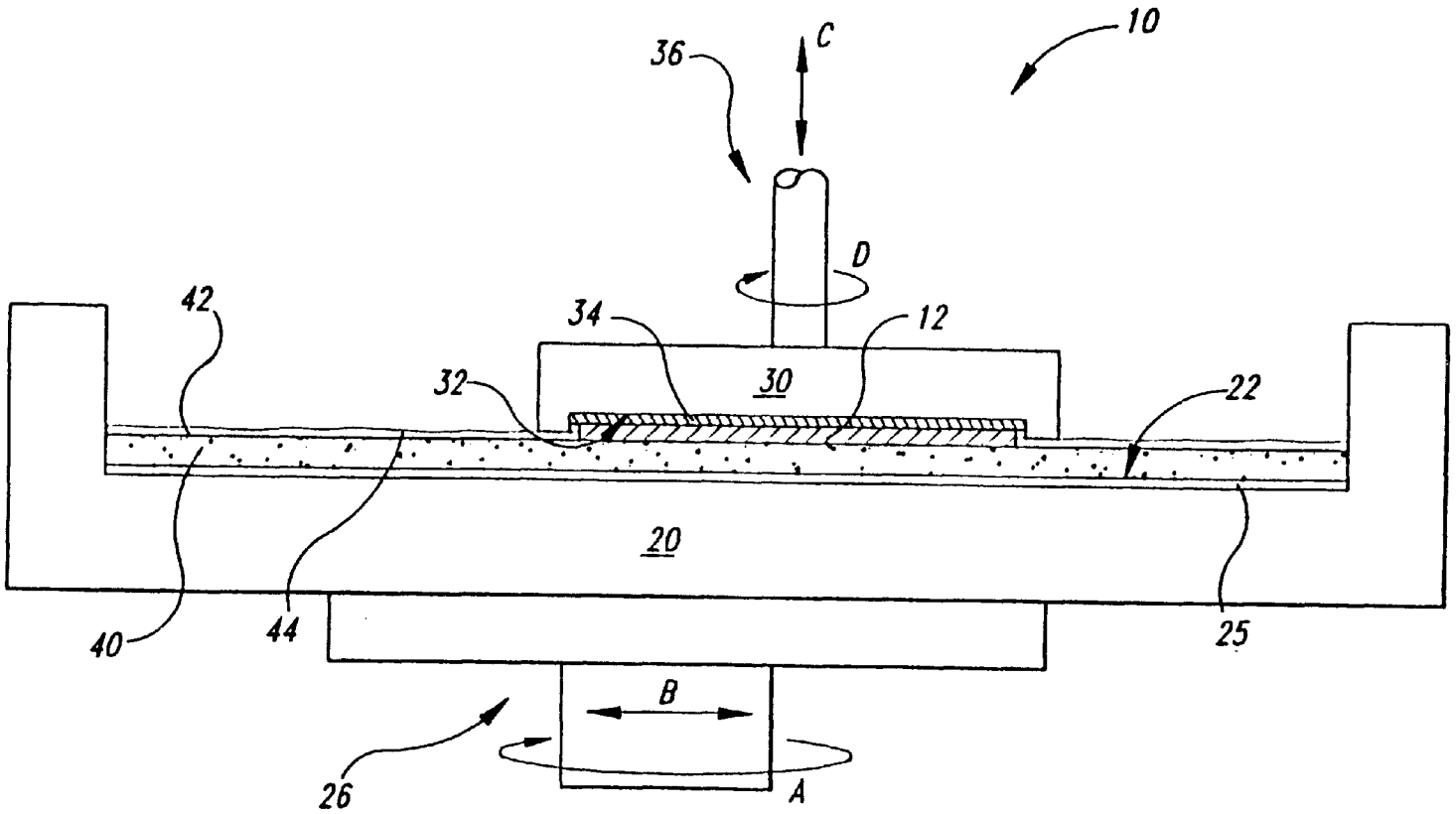
Fig. 1 (Prior Art)
FIG. 1 is a schematic cross-sectional view of a polishing machine used in chemical-mechanical polishing in accordance with the prior art
Figure 2:
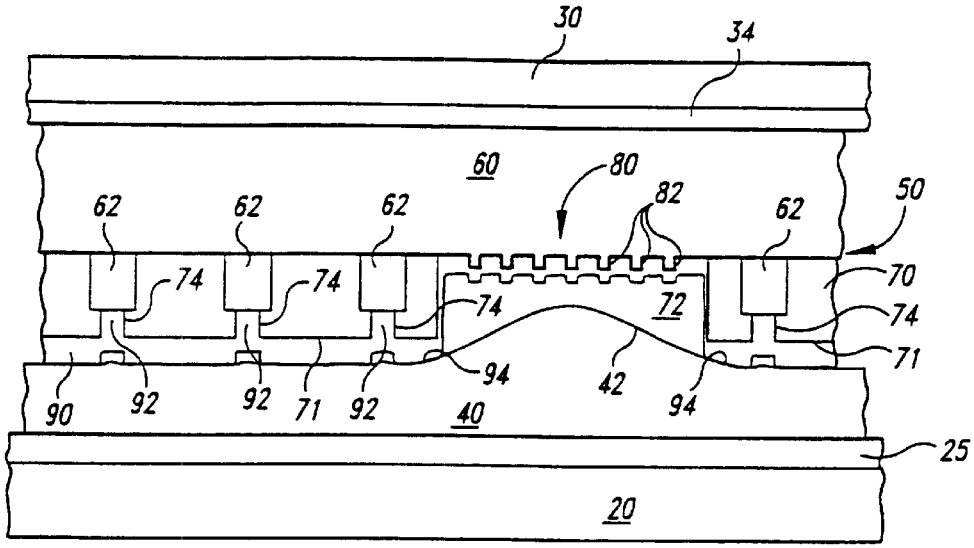
Fig. 2 (Prior Art)
FIG. 2 is a partial schematic cross-sectional view of a conventional wafer mounted to a polishing machine in accordance with the prior art
Figure 7:
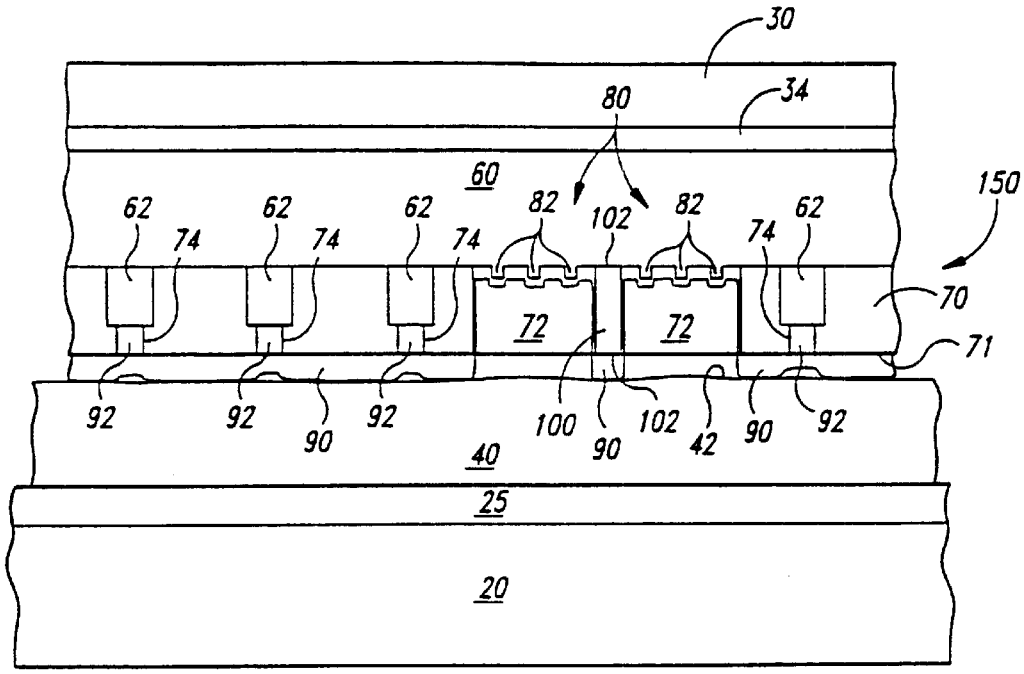
FIG. 7 is a partial schematic cross-sectional view of a wafer in accordance with the invention being polished by a chemical-mechanical polishing process at one point in time.
Figure 8:
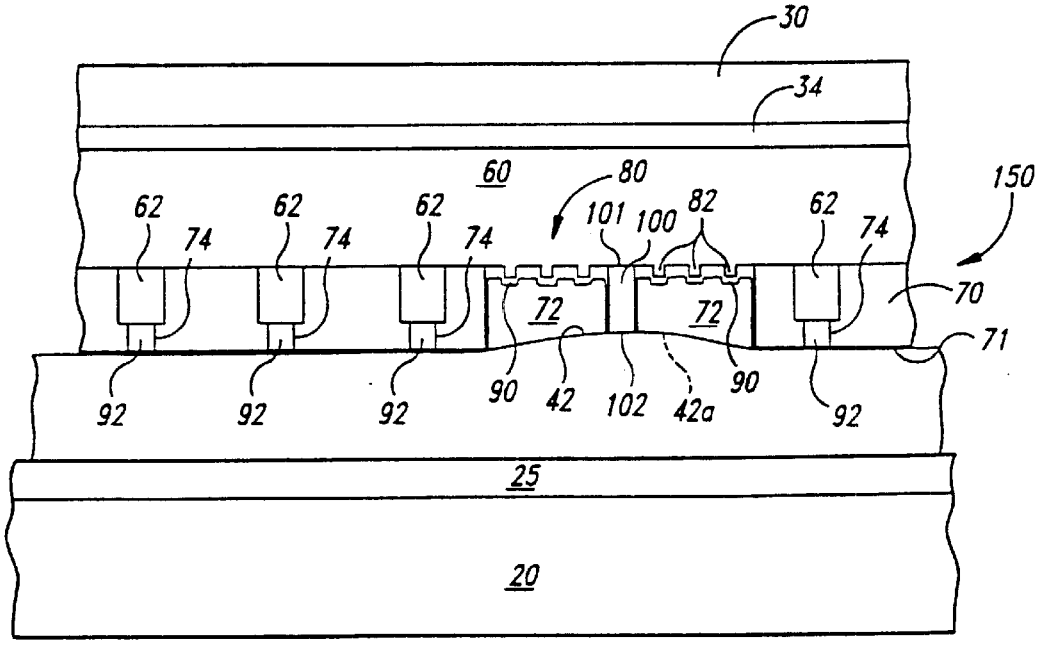
FIG. 8 is a partial schematic cross-sectional view of the wafer of FIG. 7 being polished by a chemical-mechanical polishing process at another point in time.

FIGS. 7 and 8 illustrate the operation of the wafer 150 in a chemical-mechanical polishing process in which it is mounted upside-down to a wafer carrier 30 and pressed against the polishing surface 42 of a polishing pad 40, as discussed above with respect to the chemical-mechanical polishing machine 10 shown in FIG. 1. Referring to FIG. 7, the upper layer 90 engages the polishing surface 42 of the polishing pad 40 while the wafer 150 and/or the polishing pad 40 are moved with respect to each other. The polishing pad 40 generally conforms to the surface of the wafer 150. Accordingly, because the largest and deepest opening in the wafer 150 is the cavity 72, the polishing surface 42 of the polishing pad 40 seeks to penetrate into the cavity. The pillar 100, however, generally supports the polishing surface 42 in the region of the cavity 72 to substantially prevent the polishing surface 42 from penetrating into the cavity. FIG. 8 shows the wafer 150 after the upper layer 90 has been polished down to the top surface 71 of the separation layer 70 to electrically isolate the interconnects 92 in the vias 74. Compared to the dishing at the surfaces 94 adjacent to the cavity 72 shown in FIG. 2, the surfaces adjacent to the cavity 72 of the wafer 150 shown in FIG. 8 are substantially planar with the rest of the top surface 71 of the separation layer 70.

One advantage of the wafer 150 is that an upper layer of material over a large area feature may be polished down to a substantially uniform planar surface. As discussed above, the wafer 150 substantially prevents dishing next to the large area feature to produce a more uniformly planar surface on the wafer 150. Additionally, in the extreme case where the pad can contact the large area feature, the pillar 100 also protects the topography of the upper layer on the large area feature. Therefore, subsequent lithographic processes on an aluminum cover layer (not shown) or other layers can be properly aligned with the wafer 150.

It will be appreciated that, although specific embodiments of the invention have been described herein for purposes of illustration, various modifications may be made without departing from the spirit and scope of the invention. Accordingly, the invention is not limited except as by the appended claims.

What is claimed is:

1. A microelectronic substrate structure for enhancing the performance of mechanical and/or chemical-mechanical planarizing processes comprising:

a substrate having an upper surface;

a separation layer on the substrate, the separation layer having a top surface;

a cavity in the separation layer, the cavity having sidewalls extending from the top surface of the separation layer towards the upper surface of the substrate and a floor;

a large area feature on the floor of the cavity, the large area feature having a plurality of raised features projecting upwardly from the floor into the cavity;

a pillar in the cavity, the pillar having a crown proximate to a plane defamed by the top surface of the separation layer; and a layer in the cavity having a contoured surface that conforms to a topography of the raised features, wherein the sidewalls of the cavity, the pillar and the contoured surface of the layer define an unoccupied void over the large area feature.

2. The microelectronic substrate of claim 1 wherein the pillar is made from the same material as the separation layer.

3. The microelectronic substrate of claim 1 wherein the pillar further comprises a base positioned between components of the large area feature.

4. The microelectronic substrate of claim 1 wherein the separation layer is made from borophosphate silicon glass.

5. The microelectronic substrate of claim 4 wherein the pillar is made from the separation layer, the pillar being formed by etching the separation layer into a desired pattern to position the pillar between components of the large area feature, and wherein the conformal layer comprises an opaque material.

6. The microelectronic substrate of claim 1 wherein the large area feature is an alignment array for aligning a stepping machine with the wafer, and wherein the void provides optical viewing of the exposed surface of conformal layer in the void.

7. The microelectronic substrate of claim 5, further comprising:

device features formed on the substrate;

vias formed in the separation layer over the device features; and interconnects positioned in the vias, the interconnects being made from a conductive material.

8. The microelectronic substrate of claim 7 wherein the conductive material is tungsten or aluminum.

9. A semiconductor wafer used in mechanical and/or chemical-mechanical planarizing of metal layers, comprising:

a substrate having an upper surface;

a separation layer on the substrate, the separation layer having a top surface and a cavity having sidewalls extending from the top surface towards the upper surface of the substrate;

a large area feature on a floor of the cavity, the large area feature having a plurality of raised features projecting upwardly from the floor into the cavity;

a support structure in the cavity, the support structure having a crown proximate to a plane defined by the top surface of the separation layer, and the support structure having a first section extending in a first direction across substantially one portion of the cavity and a second section extending in a second direction normal to the first direction across substantially another portion of the cavity; and a metal conformal layer in the cavity having an upper surface that conforms to a topography of the raised features, wherein the sidewalls of the cavity, the support structure, and the upper surface of the conformal metal layer define a void over the large area feature.

10. The wafer of claim 9 wherein the support structure is made from the same material as the separation layer.

11. The wafer of claim 9 wherein the support structure further comprises a base positioned between components of the large area feature.

12. The wafer of claim 9 wherein the large area feature is an alignment array for aligning a stepping machine with the wafer.

13. The wafer of claim 9 wherein the separation layer is made from borophosphate silicon glass.

14. The wafer of claim 13 wherein the support structure is made from the separation layer, the support structure being formed by etching the separation layer into a desired pattern to position the support structure between components of the large area feature.

15. The wafer of claim 14, further comprising:

device features formed on the substrate;

vias formed in the separation layer over the device feats; and interconnects positioned in the vias, the interconnect being made from a conducive material.

16. The wafer of claim 15 wherein the conductive material is tungsten or aluminum.

17. A microelectronic substrate structure for enhancing the performance of mechanical and/or chemical-mechanical planarizing processes comprising:

a substrate having an upper surface;

a separation layer on the substrate, the separation layer having a top surface;

a cavity in the separation layer, the cavity having sidewalls extending from the top surface of the separation layer towards the upper surface of the substrate and a floor;

a large area feature on the floor of the cavity, the large area feature having a plurality of raised features projecting upwardly from the floor into the cavity;

a pillar in the cavity, the pillar having a crown proximate to a plane defamed by the top surface of the separation layer; and an upper layer on the separation layer and in the cavity, wherein a portion of the upper layer closely follows the contour of the raised features projecting upwardly from the floor of the cavity so that a stepper can scan the topography of the raised features, and wherein another portion of the upper layer is on the crown of the pillar.

18. The microelectronic substrate structure of claim 17 wherein the pillar is made from the same material as the separation layer.

19. The microelectronic substrate structure of claim 17 wherein the pillar further comprises a base positioned between the raised features of the large area feature.

20. The microelectronic substrate structure of claim 17 wherein:

the pillar is made from the separation layer and the pillar further comprises a base positioned between the raised features of the large area feature; and the upper layer comprises an opaque material.

21. The microelectronic substrate structure of claim 17, further comprising:

device features formed on the substrate;

vias formed in the separation layer over the device features; and interconnects positioned in the vias, the interconnects being made from a conductive material.

* * * * *

UNITED STATES PATENT AND TRADEMARK OFFICE

CERTIFICATE OF CORRECTION

PATENT NO. : 6,633,084 B1
DATED : October 14, 2003
INVENTOR(S) : Gurtej Singh Sandhu et al.

It is certified that error appears in the above-identified patent and that said Letters Patent is hereby corrected as shown below:

Column 1,
Line 45, delete comma between "another" and "type";

Column 2,
Line 2, "photo-patters" should be -- photo-patterns --;

Column 3,
Line 34, insert period after "art";
Line 37, insert period after "art";
Line 39, insert period after "invention";

Column 4,
Line 1, delete comma between "of" and "the";
Line 20, insert comma between "("BPSG")" and "but";
Line 30, delete comma between "70" and "to";
Line 34, "walls 78" should be -- walls 73 --;
Line 35, "positioned it" should be -- positioned at --;

Column 6,
Line 9, "defamed" should be -- defined --;

Column 8,
Line 2, "defamed" should be -- defined --;

Signed and Sealed this

Twentieth Day of January, 2004

JON W. DUDAS
*Acting Director of the United States Patent and Trademark Office*